US007624683B2

(12) United States Patent
Lloyd

(10) Patent No.: US 7,624,683 B2
(45) Date of Patent: Dec. 1, 2009

(54) KINETIC ENERGY ROD WARHEAD WITH PROJECTILE SPACING

(75) Inventor: Richard M. Lloyd, Melrose, MA (US)

(73) Assignee: Raytheon Company, Waltham, MA (US)

( * ) Notice: Subject to any disclaimer, the term of this patent is extended or adjusted under 35 U.S.C. 154(b) by 438 days.

(21) Appl. No.: 11/185,135

(22) Filed: Jul. 20, 2005

(65) Prior Publication Data

US 2006/0283347 A1 Dec. 21, 2006

Related U.S. Application Data

(63) Continuation-in-part of application No. 11/059,891, filed on Feb. 17, 2005, and a continuation-in-part of application No. 11/060,179, filed on Feb. 17, 2005, each and a continuation-in-part of application No. 10/938,355, filed on Sep. 10, 2004, which is a continuation-in-part of application No. 10/924,104, filed on Aug. 23, 2004, now abandoned, each which is a continuation-in-part of application No. 10/456,777, filed on Jun. 6, 2003, now Pat. No. 6,910,423, which is a continuation-in-part of application No. 09/938,022, filed on Aug. 23, 2001, now Pat. No. 6,598,534.

(51) Int. Cl.
*F42B 12/32* (2006.01)

(52) U.S. Cl. ..... 102/497

(58) Field of Classification Search ..... 102/385, 102/494–497
See application file for complete search history.

(56) References Cited

U.S. PATENT DOCUMENTS 1,198,035 A 9/1916 Huntington
1,229,421 A 6/1917 Downs
1,235,076 A 7/1917 Stanton
1,244,046 A 10/1917 Ffrench (Continued)

FOREIGN PATENT DOCUMENTS

DE 3327043 A1 2/1985

(Continued)

OTHER PUBLICATIONS

Richard M. Lloyd, "Physics of Direct Hit and Near Miss Warhead Technology", vol. 194, Progress in Astronautics and Aeronautics, Copyright 2001 by the American Institute of Aeronautics and Astronautics, Inc., Chapter 3, pp. 99-197.

(Continued)

*Primary Examiner*—Troy Chambers
(74) *Attorney, Agent, or Firm*—Iandiorio Teska & Coleman

(57) ABSTRACT

A kinetic energy rod warhead bay configuration includes a plurality of bays. Each bay includes a plurality of rods, an explosive for deploying the rods, and a detonator for detonating the explosive. One bay is structured and arranged as a first bay. One bay is structured and arranged as a last bay with rods configured to have more drag than the rods of the first bay. At least one other bay is structured and arranged as an intermediate bay. The rods of the intermediate bay are configured to have more drag than the rods of the first bay but less drag than the rods of the last bay to space apart the rod sets of the bays upon deployment.

19 Claims, 7 Drawing Sheets

U.S. PATENT DOCUMENTS

| | | | | | |
|---|---|---|---|---|---|
| 1,300,333 | A | | 4/1919 | Berry | |
| 1,305,967 | A | | 6/1919 | Hawks | |
| 2,296,980 | A | | 9/1942 | Carmichael | |
| 2,308,683 | A | | 1/1943 | Forbes | |
| 2,322,624 | A | | 6/1943 | Forbes | |
| 2,337,765 | A | | 12/1943 | Nahirney | |
| 2,338,274 | A | | 1/1944 | Yancey | |
| 2,925,965 | A | | 2/1960 | Pierce | |
| 2,988,994 | A | | 6/1961 | Fleischer, Jr. et al. | |
| 3,081,703 | A | | 3/1963 | Kamp et al. | |
| 3,111,086 | A | * | 11/1963 | Alperstein | 102/393 |
| 3,332,348 | A | | 7/1967 | Myers et al. | |
| 3,464,356 | A | * | 9/1969 | Salzman et al. | 102/489 |
| 3,565,009 | A | | 2/1971 | Allred et al. | |
| 3,656,433 | A | | 4/1972 | Thrailkill et al. | |
| 3,665,009 | A | | 5/1972 | Dickinson, Jr. | |
| 3,670,648 | A | | 6/1972 | Cole et al. | |
| 3,757,694 | A | | 9/1973 | Talley et al. | |
| 3,771,455 | A | | 11/1973 | Haas | |
| 3,796,159 | A | | 3/1974 | Conger | |
| 3,797,359 | A | | 3/1974 | Mawhinney et al. | |
| 3,818,833 | A | | 6/1974 | Throner, Jr. | |
| 3,846,878 | A | | 11/1974 | Monson et al. | |
| 3,851,590 | A | | 12/1974 | LaCosta | |
| 3,857,338 | A | | 12/1974 | Bucklisch | |
| 3,861,314 | A | | 1/1975 | Barr | |
| 3,877,376 | A | | 4/1975 | Kupelian | |
| 3,902,424 | A | | 9/1975 | Dietsch et al. | |
| 3,903,804 | A | | 9/1975 | Luttrell et al. | |
| 3,915,092 | A | | 10/1975 | Monson et al. | |
| 3,941,059 | A | | 3/1976 | Cobb | |
| 3,949,674 | A | | 4/1976 | Talley | |
| 3,954,060 | A | | 5/1976 | Haag et al. | |
| 3,977,330 | A | | 8/1976 | Held | |
| 4,015,527 | A | | 4/1977 | Evans | |
| 4,026,213 | A | | 5/1977 | Kempton | |
| 4,036,140 | A | | 7/1977 | Korr et al. | |
| 4,089,267 | A | | 5/1978 | Mescall et al. | |
| 4,106,410 | A | | 8/1978 | Borcher et al. | |
| 4,147,108 | A | | 4/1979 | Gore et al. | |
| 4,172,407 | A | | 10/1979 | Wentink | |
| 4,210,082 | A | | 7/1980 | Brothers | |
| 4,211,169 | A | | 7/1980 | Brothers | |
| 4,231,293 | A | | 11/1980 | Dahn et al. | |
| 4,289,073 | A | | 9/1981 | Romer et al. | |
| 4,353,305 | A | | 10/1982 | Moreau et al. | |
| 4,376,901 | A | | 3/1983 | Pettibone et al. | |
| 4,430,941 | A | | 2/1984 | Raech, Jr. et al. | |
| 4,455,943 | A | | 6/1984 | Pinson | |
| 4,516,501 | A | | 5/1985 | Held et al. | |
| 4,538,519 | A | | 9/1985 | Witt et al. | |
| 4,638,737 | A | | 1/1987 | McIngvale | |
| 4,655,139 | A | | 4/1987 | Wilhelm | |
| 4,658,727 | A | | 4/1987 | Wilhelm et al. | |
| 4,676,167 | A | | 6/1987 | Huber, Jr. et al. | |
| 4,729,321 | A | | 3/1988 | Stafford | |
| 4,745,864 | A | | 5/1988 | Craddock | |
| 4,760,793 | A | * | 8/1988 | Herring, III | 102/460 |
| 4,770,101 | A | | 9/1988 | Robertson et al. | |
| 4,777,882 | A | | 10/1988 | Dieval | |
| 4,848,239 | A | | 7/1989 | Wilhelm | |
| 4,872,409 | A | | 10/1989 | Becker et al. | |
| 4,922,826 | A | | 5/1990 | Busch et al. | |
| 4,957,046 | A | | 9/1990 | Puttock | |
| 4,978,088 | A | | 12/1990 | Himmert et al. | |
| 4,995,573 | A | | 2/1991 | Wallow | |
| 4,996,923 | A | | 3/1991 | Theising | |
| 5,020,436 | A | | 6/1991 | Coburn | |
| H1047 | H | | 5/1992 | Henderson et al. | |
| H1048 | H | | 5/1992 | Wilson et al. | |
| 5,182,418 | A | | 1/1993 | Talley | |
| 5,223,667 | A | | 6/1993 | Anderson | |
| 5,229,542 | A | | 7/1993 | Bryan et al. | |
| 5,313,890 | A | | 5/1994 | Cuadros | |
| 5,370,053 | A | | 12/1994 | Williams et al. | |
| 5,498,160 | A | * | 3/1996 | Farina et al. | 434/12 |
| 5,524,524 | A | | 6/1996 | Richards et al. | |
| 5,535,679 | A | | 7/1996 | Craddock | |
| 5,542,354 | A | | 8/1996 | Sigler | |
| 5,544,589 | A | | 8/1996 | Held | |
| 5,577,431 | A | | 11/1996 | Küsters | |
| 5,578,783 | A | | 11/1996 | Brandeis | |
| 5,583,311 | A | | 12/1996 | Rieger | |
| 5,622,335 | A | | 4/1997 | Trouillot et al. | |
| D380,784 | S | | 7/1997 | Smith | |
| 5,670,735 | A | | 9/1997 | Ortmann et al. | |
| 5,691,502 | A | | 11/1997 | Craddock et al. | |
| 5,796,031 | A | | 8/1998 | Sigler | |
| 5,823,469 | A | | 10/1998 | Arkhangelsky et al. | |
| 5,929,370 | A | | 7/1999 | Brown et al. | |
| 5,936,191 | A | | 8/1999 | Bisping et al. | |
| 6,010,580 | A | | 1/2000 | Dandliker et al. | |
| 6,035,501 | A | | 3/2000 | Bisping et al. | |
| 6,044,765 | A | | 4/2000 | Regebro | |
| 6,073,880 | A | | 6/2000 | Voigt et al. | |
| 6,186,070 | B1 | | 2/2001 | Fong et al. | |
| 6,223,658 | B1 | | 5/2001 | Rosa et al. | |
| 6,240,849 | B1 | | 6/2001 | Holler | |
| 6,276,277 | B1 | | 8/2001 | Schmacker | |
| 6,279,478 | B1 | | 8/2001 | Ringer et al. | |
| 6,279,482 | B1 | | 8/2001 | Smith et al. | |
| 6,598,534 | B2 | | 7/2003 | Lloyd et al. | |
| 6,622,632 | B1 | | 9/2003 | Spivak | |
| 6,640,723 | B2 | * | 11/2003 | Spivak et al. | 102/483 |
| 6,666,145 | B1 | | 12/2003 | Nardone et al. | |
| 6,978,967 | B1 | | 12/2005 | Scheper et al. | |
| 2003/0019386 | A1 | | 1/2003 | Lloyd et al. | |
| 2003/0029347 | A1 | | 2/2003 | Lloyd | |
| 2004/0011238 | A1 | | 1/2004 | Ronn et al. | |
| 2004/0055498 | A1 | | 3/2004 | Lloyd | |
| 2004/0055500 | A1 | * | 3/2004 | Lloyd et al. | 102/494 |
| 2004/0129162 | A1 | | 7/2004 | Lloyd | |
| 2004/0200380 | A1 | | 10/2004 | Lloyd | |
| 2005/0016372 | A1 | | 1/2005 | Klivert | |
| 2005/0109234 | A1 | | 5/2005 | Lloyd | |
| 2005/0115450 | A1 | | 6/2005 | Lloyd | |
| 2005/0126421 | A1 | | 6/2005 | Lloyd | |
| 2005/0132923 | A1 | | 6/2005 | Lloyd | |

FOREIGN PATENT DOCUMENTS

| | | | | |
|---|---|---|---|---|
| DE | 3722420 | | | 1/1989 |
| DE | 3735426 | | | 5/1989 |
| DE | 3830527 | A1 | | 3/1990 |
| DE | 3834367 | | | 4/1990 |
| DE | 3934042 | A1 | | 4/1991 |
| DE | 19524726 | A1 | * | 2/1996 |
| EP | 270 401 | A1 | | 6/1988 |
| EP | 872705 | | | 10/1998 |
| EP | 902250 | | | 3/1999 |
| FR | 2678723 | A1 | | 1/1993 |
| FR | 2695467 | | | 3/1994 |
| GB | 550001 | | | 12/1942 |
| GB | 2236581 | | | 4/1991 |
| JP | 1-296100 | | | 11/1989 |
| WO | WO 97/27447 | | | 7/1997 |
| WO | WO 9930966 | | | 6/1999 |
| WO | WO 02/14780 | A1 | | 2/2002 |

OTHER PUBLICATIONS

Richard M. Lloyd, "Physics of Direct Hit and Near Miss Warhead Technology", vol. 194, Progress in Astronautics and Aeronautics, Copyright 2001 by the American Institute of Aeronautics and Astronautics, Inc., Chapter 6, pp. 311-406.

FAS Military Analysis Network (http://www.fas.org/man/dod-101/sys/land/m546.htm): M546 APERS-T 105-mm, Jan. 21, 1999.

FAS Military Analysis Network (http://www.fas.org/man/dod-101/sys/land/bullets2.htm): Big Bullets for Beginners, Feb. 6, 2000.

Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 5, pp. 193-251.

Richard M. Lloyd, "Aligned Rod Lethality Enhanced Concept for Kill Vehicles", 10th AIAA/BMDD Technology Conf., Jul. 23-26, Williamsburg, Virginia, 2001, pp. 1-12.

Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 2, pp. 19-77.

U.S. Appl. No. 10/301,420, filed Nov. 21, 2002, Lloyd.

U.S. Appl. No. 10/685,242, filed Oct. 14, 2003, Lloyd.

U.S. Appl. No. 10/924,104, filed Aug. 23, 2004, Lloyd.

U.S. Appl. No. 10/960,842, filed Oct. 7, 2004, Lloyd.

U.S. Appl. No. 11/059,891, filed Feb. 17, 2005, Lloyd.

U.S. Appl. No. 11/060,179, filed Feb. 17, 2005, Lloyd.

U.S. Appl. No. 11/185,555, filed Jul. 20, 2005, Lloyd.

U.S. Appl. No. 11/185,521, filed Jul. 20, 2005, Lloyd.

Richard M. Lloyd. "Aligned Rod Lethality Enhancement Concept for Kill Vehicles," AIAA/BMDD Technology Conf., Jun. 5, Maastricht, Netherlands, 2001: pp. 1-12.

* cited by examiner

KINETIC ENERGY ROD WARHEAD WITH PROJECTILE SPACING

RELATED APPLICATIONS

This application is a Continuation-in-Part of prior U.S. patent application Ser. No. 11/059,891 filed Feb. 17, 2005 and this application is a Continuation-in-Part of prior U.S. patent application Ser. No. 11/060,179 filed Feb. 17, 2005, and the latter applications are each a Continuation-in-Part application of prior U.S. patent application Ser. No. 10/924,104 filed Aug. 23, 2004 now abandoned and a Continuation-in-Part application of prior U.S. patent application Ser. No. 10/938,355 filed Sep. 10, 2004, and each of these latter two applications are a Continuation-in-Part of prior U.S. patent application Ser. No. 10/456,777, filed Jun. 6, 2003 now U.S. Pat. No. 6,910,423 which is a Continuation-in-Part of prior U.S. patent application Ser. No. 09/938,022 filed Aug. 23, 2001, issued on Jul. 29, 2003 as U.S. Pat. No. 6,598,534B2. All of these patent applications and patents are incorporated herein by reference.

FIELD OF THE INVENTION

This subject invention relates to improvements in kinetic energy rod warheads.

BACKGROUND OF THE INVENTION

Destroying missiles, aircraft, re-entry vehicles and other targets falls into three primary classifications: "hit-to-kill" vehicles, blast fragmentation warheads, and kinetic energy rod warheads.

"Hit-to-kill" vehicles are typically launched into a position proximate a re-entry vehicle or other target via a missile such as the Patriot, Trident or MX missile. The kill vehicle is navigable and designed to strike the re-entry vehicle to render it inoperable. Countermeasures, however, can be used to avoid the "hit-to-kill" vehicle. Moreover, biological warfare bomblets and chemical warfare submunition payloads are carried by some "hit-to-kill" threats and one or more of these bomblets or chemical submunition payloads can survive and cause heavy casualties even if the "hit-to-kill" vehicle accurately strikes the target.

Blast fragmentation type warheads are designed to be carried by existing missiles. Blast fragmentation type warheads, unlike "hit-to-kill" vehicles, are not navigable. Instead, when the missile carrier reaches a position close to an enemy missile or other target, a pre-made band of metal on the warhead is detonated and the pieces of metal are accelerated with high velocity and strike the target. The fragments, however, are not always effective at destroying the target and, again, biological bomblets and/or chemical submunition payloads survive and cause heavy casualties.

The textbooks by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, and "Physics of Direct Hit and Near Miss Warhead Technology", Volume 194, ISBN 1-56347-473-5, incorporated herein by this reference, provide additional details concerning "hit-to-kill" vehicles and blast fragmentation type warheads. Chapter 5 and Chapter 3 of these textbooks propose a kinetic energy rod warhead.

The two primary advantages of a kinetic energy rod warhead is that 1) it does not rely on precise navigation as is the case with "hit-to-kill" vehicles and 2) it provides better penetration than blast fragmentation type warheads.

In previous designs, one set of rod projectiles or penetrators from a single kinetic energy rod warhead is deployed to destroy a target. Some targets, however, may not be completely destroyed by the plurality of rods from this single kinetic energy rod warhead. Some of the rods may miss the target, others may not penetrate the target, and even those that hit and penetrate the target may not be sufficient to effectively destroy the target. Moreover, it may not be feasible or possible to address a single target with multiple warheads each carried by a single missile.

SUMMARY OF THE INVENTION

It is therefore an object of this invention to provide an improved kinetic energy rod warhead.

It is a further object of this invention to provide a kinetic energy rod warhead with increased ability to penetrate a target.

It is a further object of this invention to provide a kinetic energy rod warhead which has a better chance of destroying a target.

It is a further object of this invention to provide a higher lethality kinetic energy rod warhead.

The subject invention results from the realization that a higher lethality kinetic energy rod warhead can be achieved in a warhead with separate projectile rod bays, each bay including rods having their own distinct drag properties thus enhancing the temporal and/or spatial separation of the rods and the overall destructive capability of the kinetic energy rod warhead.

The present invention thus provides a unique way to destroy a target, and may be used exclusively, or in conjunction with any of the warhead configurations and/or features for destroying targets disclosed in the applicant's other patents or patent applications, including but not limited to the features for kinetic energy rod warheads disclosed in U.S. patent application Ser. Nos. 11/059,891 and 11/060,179 to which this application claims priority and which are incorporated herein by reference, and/or other features as desired for a particular application.

The subject invention, however, in other embodiments, need not achieve all these objectives and the claims hereof should not be limited to structures or methods capable of achieving these objectives.

This invention features a kinetic energy rod warhead bay configuration including a plurality of bays. Each of the bays includes a plurality of rods, an explosive or explosive charge for deploying the rods, and a detonator for detonating the explosive. One bay is structured and arranged as the first bay, wherein the rods of the first bay are configured to have drag. One bay is structured and arranged as the last bay, wherein the rods of the last bay are configured to have more drag than the rods of the first bay. At least one bay is structured and arranged as an intermediate bay, wherein the rods of the intermediate bay are configured to have more drag than the rods of the first bay but less drag than the rods of the last bay to space apart the rods of the bays upon deployment. The rods may be lengthy cylindrical members made of tungsten. The warhead may further include shields between the plurality of bays for separating the bays, and the shields may be made of steel sandwiched between composite material. The plurality of bays may each include inner end plates proximate the plurality of rods and the inner end plates may be made of aluminum sandwiched between composite material.

The rods of the last bay and the intermediate bay may include a drag inducer which is collapsible and unfurls when the rods are deployed. The drag inducer may be compactly stored until deployment. The drag inducer may include drag flaps attached at or proximate a distal end of the rod. The drag flap may be made of spring steel. The drag inducer may include a parachute attached at or proximate a distal end of the rod, or the drag inducer may include a flare attachment connected at or proximate a distal end of the rod. The drag inducer may include streamers attached at or proximate a distal end of rod. The streamers may be made of plastic. The last bay rods may have a cross-sectional area greater than a cross-sectional area of rods of the intermediate bay, and the cross-sectional area of the intermediate bay rods may be greater than a cross-sectional area of the rods of the first bay.

This invention also features a kinetic energy rod warhead bay configuration including a plurality of bays. Each of the bays includes a plurality of rods, an explosive for deploying the rods, and a detonator for detonating the explosive. One bay is structured and arranged as the first bay. One bay is structured and arranged as the last bay, wherein the rods of the last bay include a drag inducer configured to induce more drag than the rods of the first bay. At least one other bay is structured and arranged as an intermediate bay, wherein the rods of said intermediate bay include a drag inducer configured to induce more drag than the rods of the first bay but less drag than the rods of the last bay to space apart the rods of said bays upon deployment.

This invention further features a kinetic energy rod warhead bay configuration including a plurality of bays. Each of the bays includes a plurality of rods, an explosive for deploying the rods, and a detonator for detonating the explosive. One bay is structured and arranged as the first bay, wherein the rods of the first bay are configured to have a predetermined cross-sectional area. One bay is structured and arranged as the last bay, wherein the rods of the last bay are configured to have a cross-sectional area greater than the cross-sectional area of the rods of the first bay. At least one other bay is structured and arranged as an intermediate bay, wherein the rods of said intermediate bay are configured to have a cross-sectional area greater than the cross-sectional area of the rods of the first bay but less than the cross-sectional area of the rods of the last bay to space apart the rods of said bays upon deployment.

This invention also features a method of spacing rods deployed from a kinetic energy rod warhead, the method including configuring the kinetic energy rod warhead to include a plurality of bays, deploying a plurality of rods from a first bay of the kinetic energy rod warhead, deploying a plurality of rods from an intermediate bay or bays of the kinetic energy rod warhead, and thereafter deploying a plurality of rods from a last bay of the kinetic energy rod warhead. The rods may be lengthy cylindrical members and made of tungsten. There may be shields between the plurality of bays for separating the bays, and the shields may be made of steel sandwiched between composite material. The plurality of bays may each include inner end plates proximate the plurality of rods, and the inner end plates may be made of aluminum sandwiched between composite material. Rods of the last and intermediate bays may include a drag inducer, which may be collapsible and which unfurls when the rods are deployed and which may be compactly stored until deployment. The drag inducer may include drag flaps attached at or proximate a distal end of the rod, and the drag flaps may be made of spring steel. The drag inducer may include a parachute attached at or proximate a distal end of the rod, or a flare attachment connected at or proximate a distal end of the rod. The drag inducer may include streamers attached at or proximate a distal end of rod, and the streamers may be made of plastic. The last bay rods may have a cross-sectional area greater than a cross-sectional area of rods of the intermediate bay, and the cross-sectional area of the intermediate bay rods may be greater than a cross-sectional area of the rods of the first bay.

This invention further features a method of spacing rods deployed from a kinetic energy rod warhead, the method including configuring the kinetic energy rod warhead to include a plurality of bays, deploying a plurality of rods from a first bay of the kinetic energy rod warhead, deploying a plurality of rods configured to have greater drag than the first bay rods from an intermediate bay or bays of the kinetic energy rod warhead, and deploying a plurality of rods configured to have greater drag than the intermediate bay rods from a last bay of the kinetic energy rod warhead. The plurality of rods from each bay may be deployed simultaneously.

This invention also features a method of spacing rods deployed from a kinetic energy rod warhead, the method including configuring the kinetic energy rod warhead to include a plurality of bays, deploying a plurality of rods having a predetermined cross-sectional area from a first bay of the kinetic energy rod warhead, deploying a plurality of rods having a cross-sectional area greater than the cross-sectional area of the first bay rods from an intermediate bay or bays of the kinetic energy rod warhead, and deploying a plurality of rods having cross-sectional area greater than the cross-sectional area of the intermediate bay rods from a last bay of the kinetic energy rod warhead. The plurality of rods from each bay may be deployed simultaneously.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
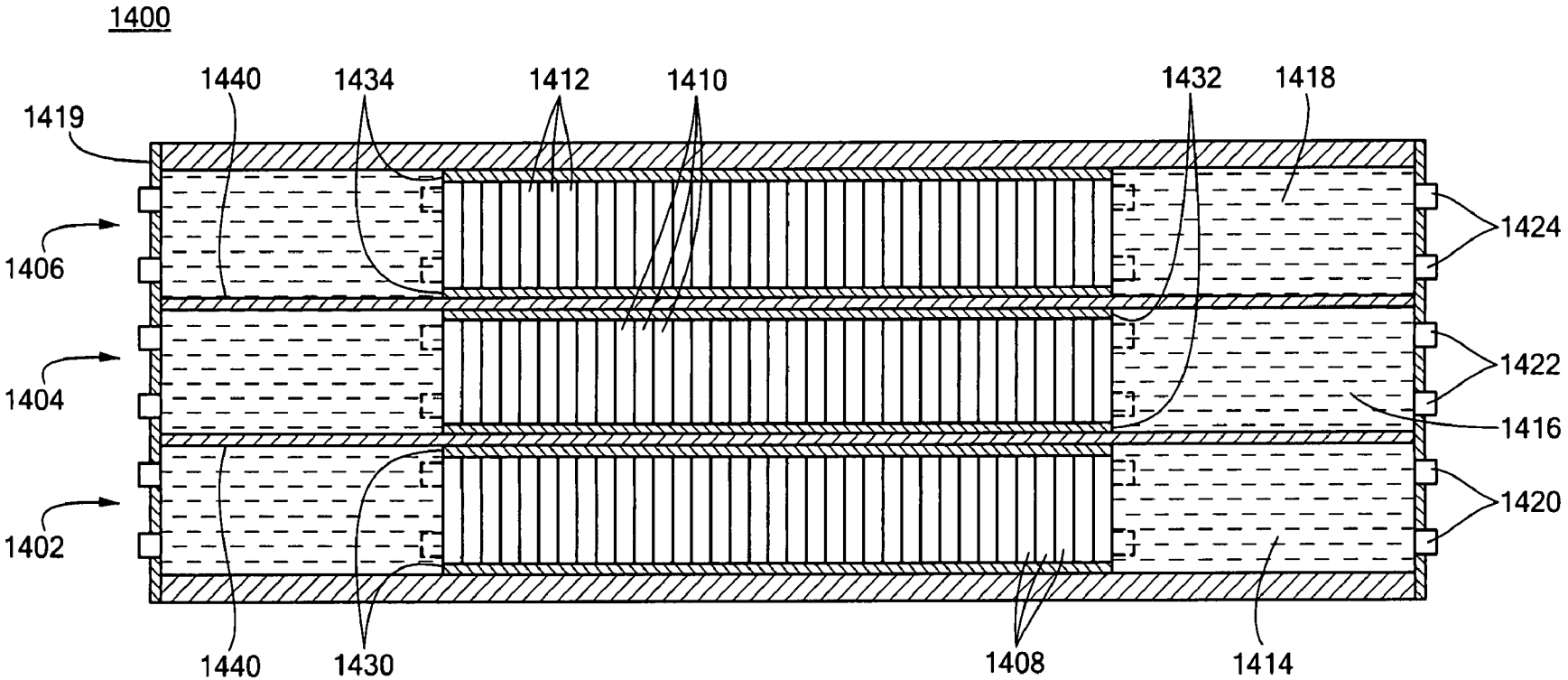
FIG. 1 is a schematic cross-sectional view of a preferred kinetic energy rod warhead configuration in accordance with the present invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Previous kinetic energy rod warhead designs deploy a single set of rod projectiles or penetrators towards a target. Aiming and aligning techniques and structures may be employed to improve accuracy, and different sized or shaped rods may be utilized for greater target effect, depending on a particular desired application. See e.g. U.S. Pat. No. 6,598,534 and U.S. Pat. Publ. No. 2005/0109234, which are incorporated herein by reference. However, there still may be some targets which are not completely destroyed by the rods from the single kinetic energy rod warhead. The alternative of utilizing more than one warhead to destroy a single target, with each warhead carried by its own missile or carrier, may not be feasible.

The kinetic energy warhead configuration and method of the present invention solves these disadvantages. By deploying multiple sets of projectiles from a single kinetic energy rod warhead, the warhead is more effective and lethal.

FIG. 1 shows a kinetic energy rod warhead bay configuration 1400 in accordance with the present invention. Bays 1402, 1404, and 1406 each include rods, an explosive charge, and one or more detonators. In one embodiment, shields 1440 and inner end plates 1430, 1432, and 1434 separate and divide warhead 1400 into bays 1402, 1404 and 1406 such that each bay can be deployed separately. Shields 1440 and inner end plates 1430, 1432, and 1434 divide and separate both the rods 1408, 1410 and 1412 and the explosive charge 1414, 1416 and 1418 within hull or housing 1419. Inner end plates 1430 proximate plurality of rods 1408 separate plurality of rods 1408 of bay 1402. Inner end plates 1432 proximate plurality of rods 1410 separate plurality of rods 1410 of bay 1404. Inner end plates 1434 proximate plurality of rods 1412 separate plurality of rods 1412 of bay 1406.

Bay 1402 includes explosive charge 1414 and detonator 1420. Bay 1404 includes explosive charge 1416 and detonator 1422, and bay 1406 includes explosive charge 1418 and detonator 1424. Explosive charge 1414, 1416, 1418 are separated by shields 1440. Detonator 1424 detonates explosive charge 1418 to deploy rods 1412. Detonator 1422 detonates explosive charge 1416 to deploy rods 1410. Detonator 1420 detonates explosive charge 1414 to deploy rods 1408.

With this configuration in accordance with the present invention, each explosive charge would deploy only the plurality of rods in its own bay. Thus, with separate bays in a single rod warhead, the rod warhead of the present invention can be carried by a single missile, for example, but in contrast to known single rod warheads, the rod warhead of the present invention acts as multiple warheads. Although three bays 1402, 1404 and 1406 are shown, the present invention is not limited to three bays. Any number of bays may be utilized as desired for a particular application. Preferably inner plates 1430, 1432 and 1434 are made of aluminum sandwiched between composite material, but may be of any suitable material. In one embodiment, shields 1440 are made of steel sandwiched between composite material, for example LEXAN, but also may be of any suitable material depending on a particular application. Additionally, in one example, each explosive charge includes multiple detonators as shown, and in one alternative the detonators may be placed at the inner surface of the explosive charge as shown in phantom.

While the separate bays in the single rod warhead as so configured provide an improvement over a warhead with only a single bay, the separate bays can be used to a greater advantage by configuring the rods of each bay in accordance with the present invention. In the preferred embodiment, bay 1402 is structured and arranged as a first bay, with the rods 1408 configured to have some drag, while bay 1406 is structured and arranged as a last bay, with rods 1412 configured to have the most drag and more drag than rods 1408. As noted, there may be more than three bays, but at least bay 1404 is structured and arranged as an intermediate bay, with rods 1410 configured to have more drag than rods 1408 of first bay 1402 but less drag than rods 1412 of last bay 1406.

Thus, with the configuration of the present invention, upon deployment, rods 1408, 1410 and 1412 will be spaced apart whether the rods of each of the bays are deployed simultaneously or at different times. This is illustrated in FIGS. 2A-3D.

Figure 2A:
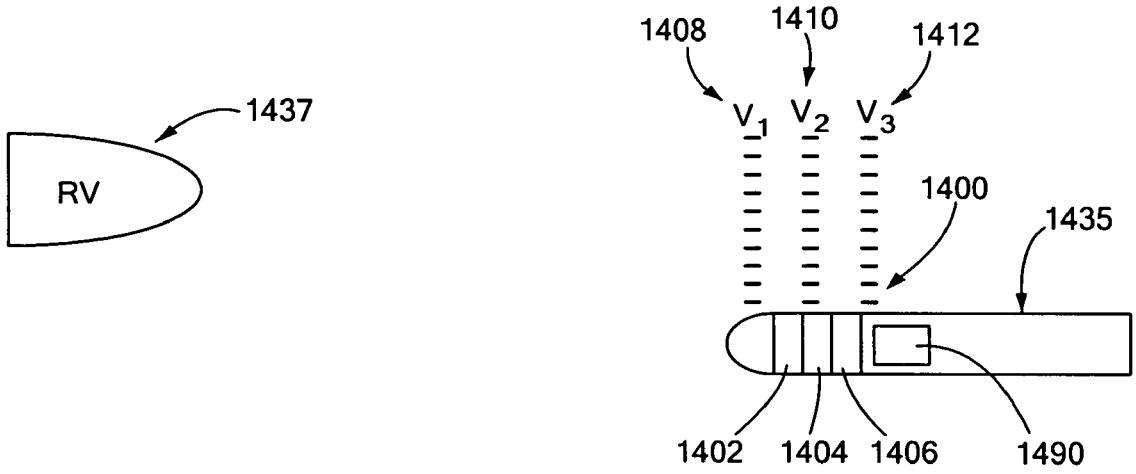
FIGS. 2A-2D are schematic views showing one example of the deployment of a kinetic energy rod warhead of the present invention.
Figure 2B:
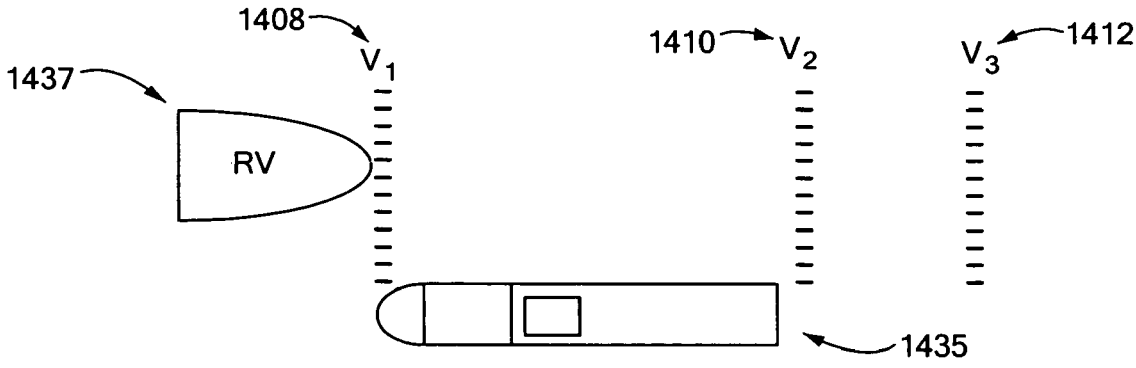
Figure 2C:
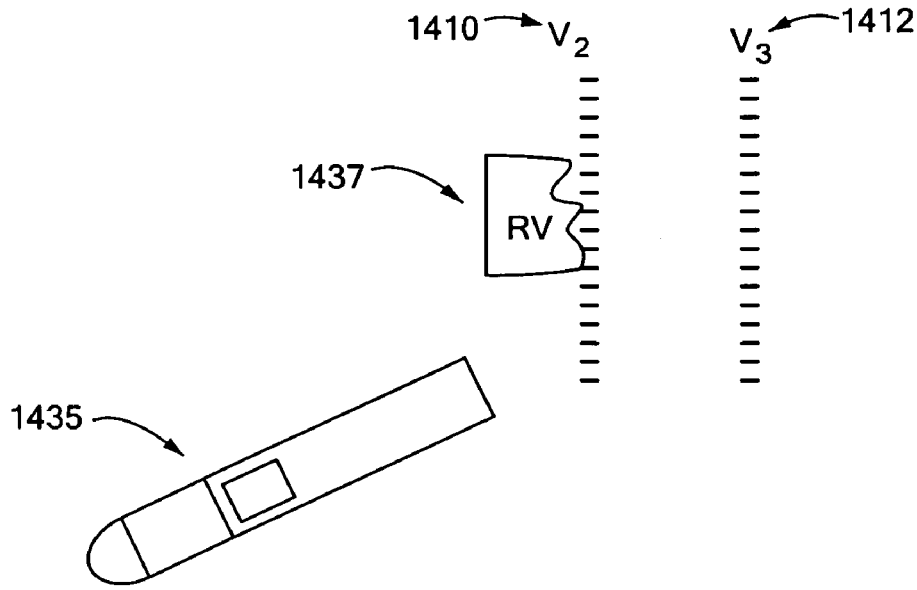
Figure 2D:
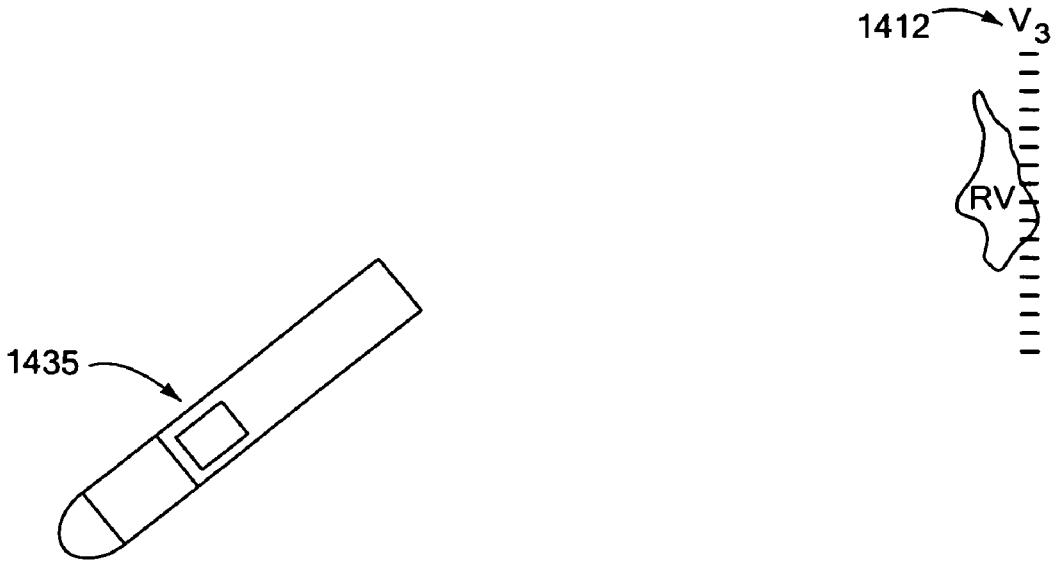

In FIG. 2A, carrier or missile 1435 carrying kinetic energy rod warhead 1400 configured in accordance with the present invention approaches target 1437, which may be a re-entry vehicle or other threat. Plurality of rods 1408, 1410 and 1412 in each of bays 1402, 1404 and 1406 are deployed simultaneously. The first bay rods set 1408, configured to have the least drag, will travel at the highest velocity $V_1$, striking target 1437 first, FIG. 2B. The second bay projectile rod set 1410 are configured to have more drag than the rods of the first bay and thus will travel at a slower velocity $V_2$, spacing rod set 1410 from rod set 1408 as shown, striking target 1437, FIG. 2C, after rod set 1408 has initially damaged target 1437. Third or last bay rod set 1412, configured to have the most drag, will travel at the slowest velocity $V_3$, resulting in spacing from both rod sets 1408 and 1410. Thus, rod set 1412 strike target 1437 after target 1437, FIG. 2D, has been substantially damaged and weakened by rod set 1408 and 1410.

Figure 3A:
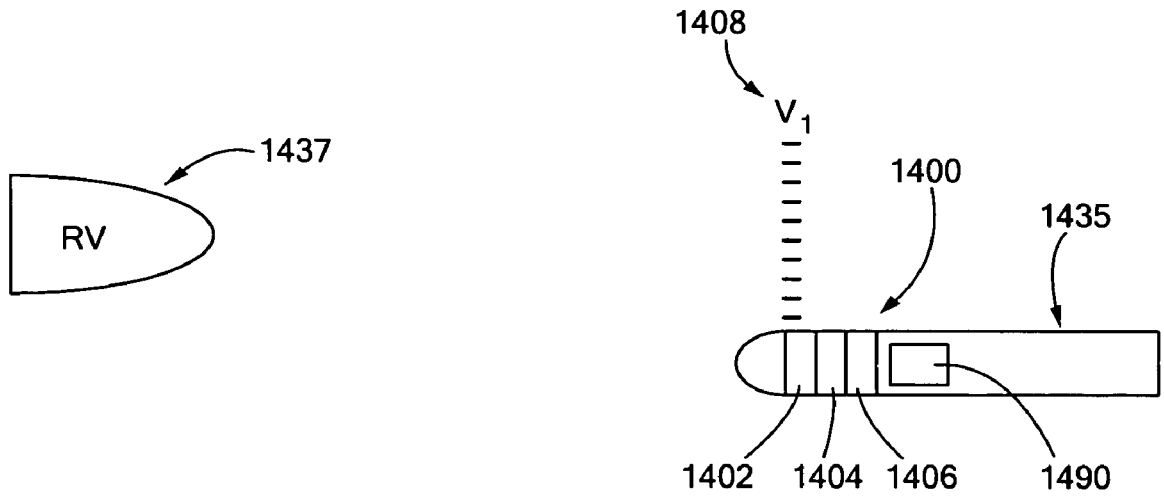
FIG. 3A-3D are schematic views showing another example of the deployment of a kinetic energy rod warhead of the present invention.
Figure 3B:
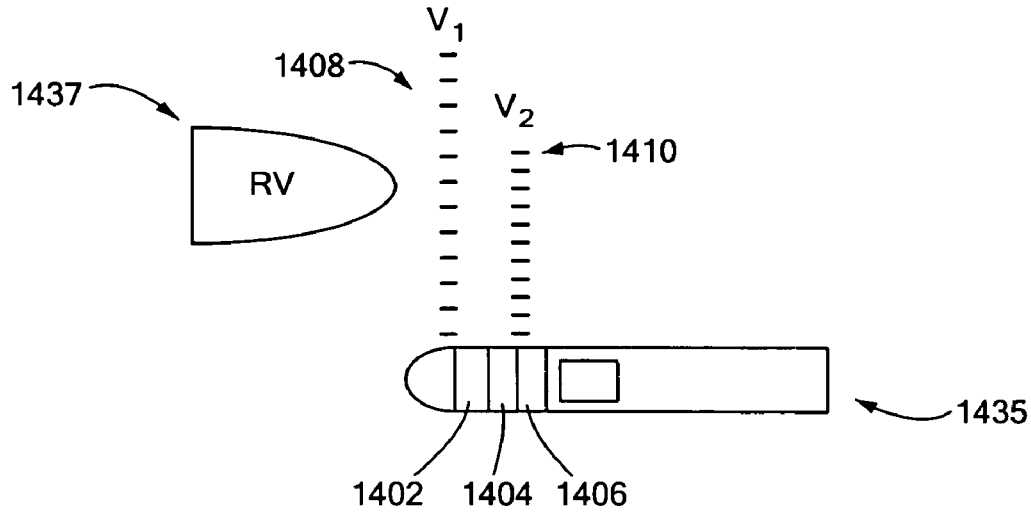
Figure 3C:
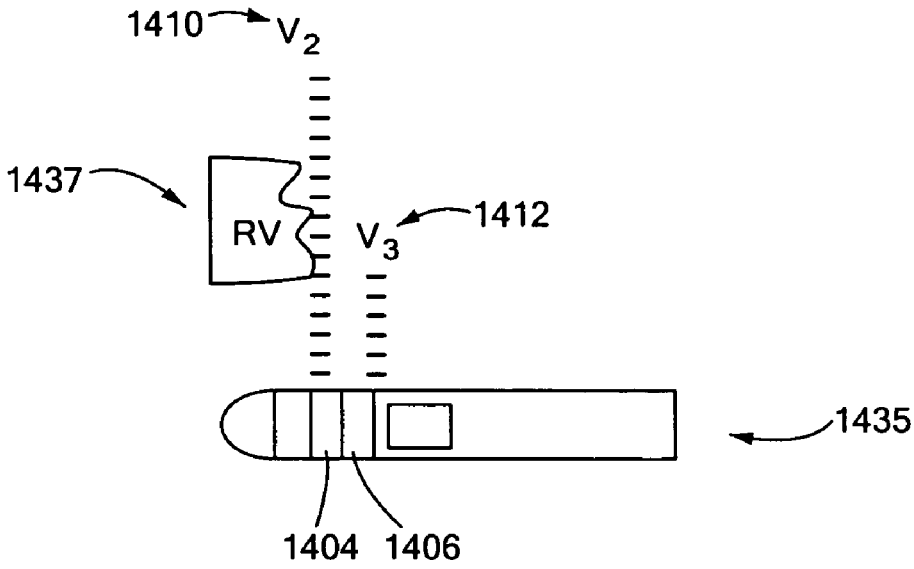
Figure 3D:
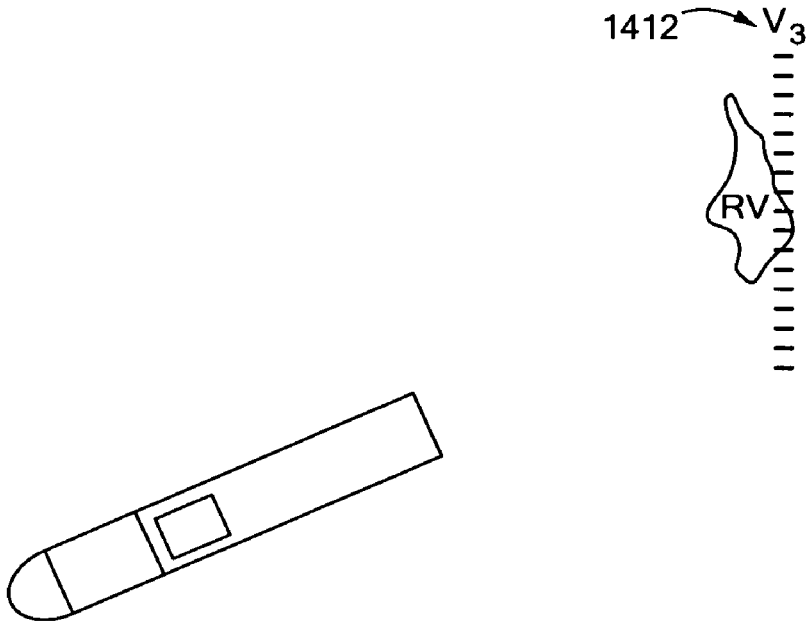

An alternative type of deployment is shown in FIGS. 3A-3D. In FIG. 3A, carrier or missile 1435 carrying kinetic energy rod warhead 1400 configured in accordance with the present invention approaches target 1437. Rod sets 1408, 1410 and 1412 in each of bays 1402, 1404 and 1406 are deployed sequentially at different times, with rod set 1408 deployed first, rod set 1410 deployed second, and rod set 1412 deployed last. Again, rod set 1408 configured to have the least drag will travel at the highest velocity $V_1$, striking target 1437 first, FIG. 3B. Projectile rod set 1410 configured to have more drag than rod set 1408 will travel at a slower velocity $V_2$, spacing rod set 1410 from rod set 1408 as shown, striking target 1437, FIG. 3C, after rod set 1408 has initially damaged target 1437. Rod set 1412, configured to have the most drag, will travel at the slowest velocity $V_3$, resulting in spacing from both rod set 1408 and 1410. Thus, rod set 1412 strikes target 1437, FIG. 3D, after target 1437 has been substantially damaged and weakened by rods 1408 and 1410. This temporal spacing may well perform better than a traditional rod warhead against, for example, hardened ballistic missile threats.

When the plurality of rods from each bay are deployed at different times, for example sequentially, some spacing is also achieved by the delay in deployment between bays. Thus, there can be some tradeoff between time delay and amount of drag on the rods in each bay, which provides added flexibility and versatility.

There are at least two ways the different rod sets may be configured to have different drag characteristics in accordance with the present invention. In one embodiment, the rods of last bay 1406, FIG. 1 and the rods of intermediate bay 1404 each include a drag inducer, FIGS. 4-7. For clarity, the following discussion refers to rod set 1412 only, but the discussion applies equally to drag inducers in connection with any of the plurality of rods in any bay. Preferably, the drag inducer, attached to each rod, is collapsible and compactly stored until deployment, and unfurls when each rod is deployed, expanding about the axis of the rod.

Figure 4:
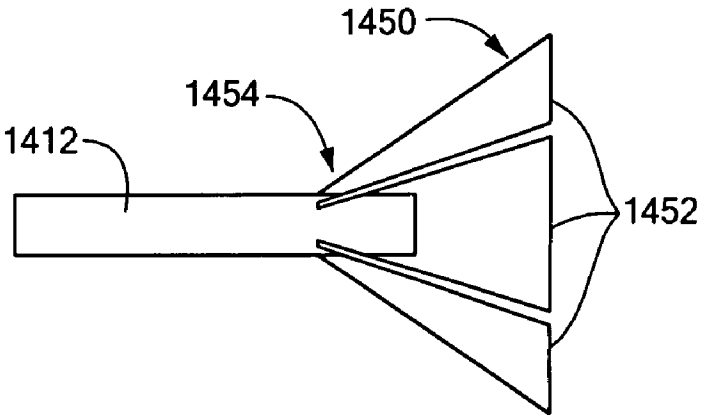

Drag inducer 1450, FIG. 4, includes drag flaps 1452 attached at or proximal distal end 1454 of projectile rod penetrator 1412. The strength and flexibility of material utilized for drag flap 1452 will depend upon the flap diameter, and the required flap diameter is a function of altitude at which kinetic energy rod warhead 1400, FIG. 1, engages a target, as well as the air density. At higher altitudes the air density is lower and therefore a larger flap diameter would be required. At lower altitudes, there is a higher air density and thus the flap diameter would be smaller. In one preferred embodiment, drag flaps 1452, FIG. 4, are made of lightweight spring steel, which may also facilitate folding until deployment. Once projectile rod 1412 is deployed, drag flap 1452 expands and provides drag.

Figure 5:
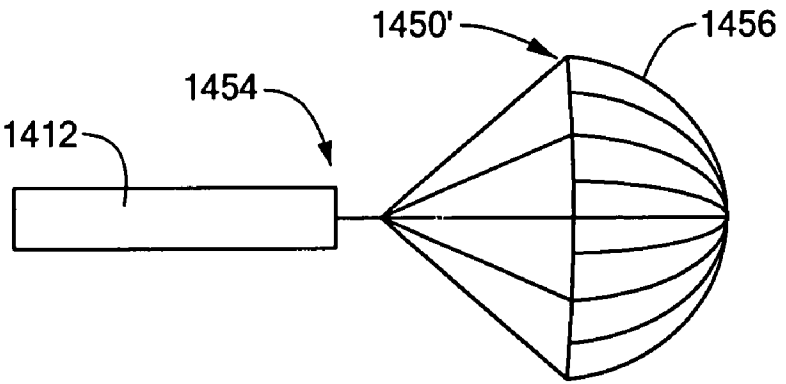
FIGS. 4-7 are schematic views of drag inducers for use with a kinetic energy rod warhead in accordance with the present invention.

Drag inducer 1450', FIG. 5, includes parachute 1456 preferably attached at or proximate a distal end 1454 of rod 1412. Use of parachute 1456 may depend on the altitude of deployment, and would preferably be used at higher altitudes where aerodynamic loads are less.

Figure 6:
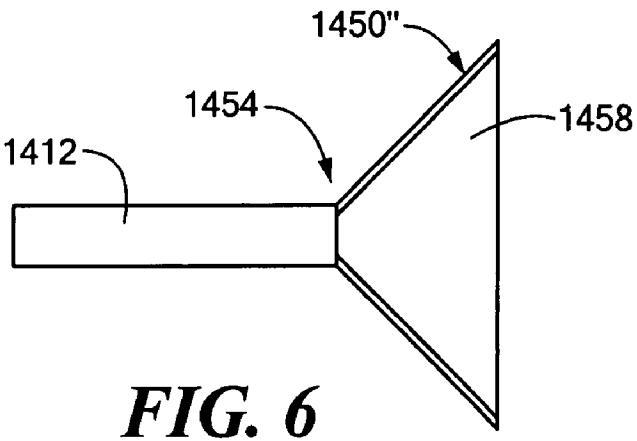

As shown in FIG. 6, drag inducer 1450" includes flare attachment or nested rod 1458 connected at or proximate distal end 1454 of rod penetrator 1412. Similar to parachute 1456, flare attachment 1458 preferably would be utilized at higher deployment altitudes.

Figure 7:
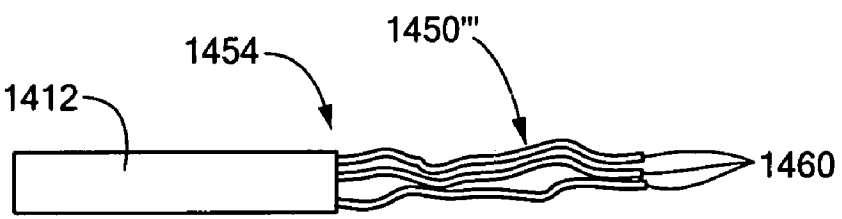

Drag inducer 1450'", FIG. 7, includes streamers 1460 preferably attached at or proximate distal end 1454 of projectile rod 1412 to move freely in the airstream. In one embodiment, streamers 1460 are made of plastic to be more easily folded or rolled up for storage prior to deployment. Preferably, streamers 1460 would be utilized at higher altitudes due to high dynamic forces at lower altitudes. Because the air density at higher altitudes is low, however, streamers 1460 utilized at such higher altitudes are preferably several feet long.

Thus, a drag inducer may be chosen for the plurality of rods in any bay to space apart the rods 1408, 1410, and 1412, FIG. 1. But, typically rods of the first bay, i.e. rods 1408 in the embodiment of FIG. 1, do not require a drag inducer at all, because drag caused by the size, shape and mass of projectiles 1408 may suffice, so long as the rods from the intermediate and last bays have greater drag, as discussed above. In one such an example, the rods of the intermediate bay each have steamer type drag inducer 1450'", FIG. 7 and the rods of the last bay have parachute type drag inducer 1450', FIG. 5.

When a drag inducer is utilized, the rods are preferably lengthy cylindrical members made of tungsten although any shape conducive to an attached drag inducer or other suitable material may be used. It is preferable to use drag inducers at higher altitudes because larger drag is required due to minimal air resistance. Intercepts with ballistic missile threats, for example, typically occur at higher altitudes.

Figure 10:
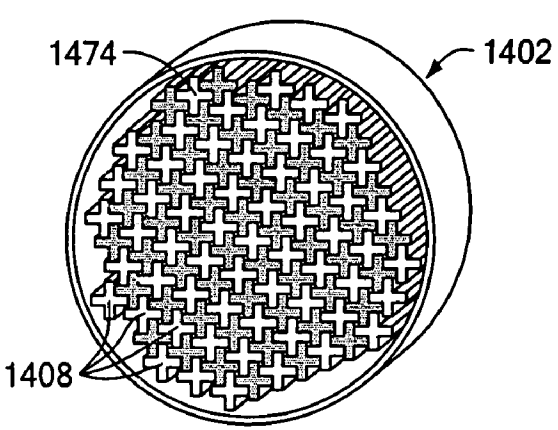
FIGS. 8-10 are schematic views of various rods for use with a kinetic energy rod warhead in accordance with the present invention.
Figure 9:
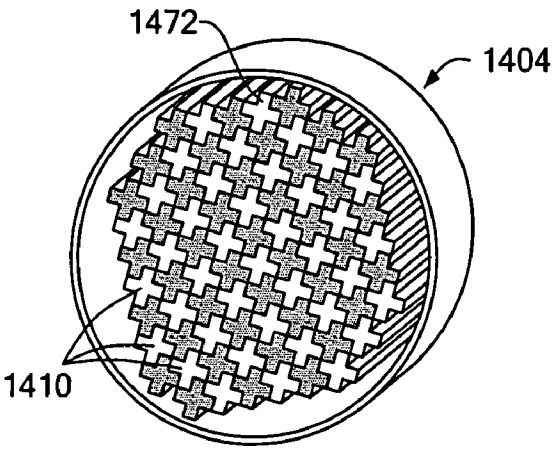
Figure 8:
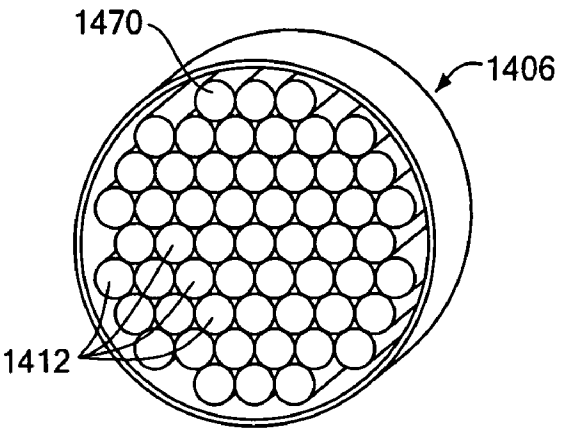

In another embodiment, the plurality of rods are configured to have drag by virtue of their respective shape, size and relative cross-sections. Thus, in this latter embodiment, the rods may also be cylindrical, but the shape of the rods is not limited to shapes which facilitate attachment of a drag inducer. In one example in accordance with the present invention, the last bay rod set 1412, FIG. 8, have a cross-sectional area 1470 greater than a cross-sectional area 1472, FIG. 9 of rod set 1410 of intermediate bay 1404, and the cross-sectional area 1472 of the intermediate bay rod set 1410 is greater than a cross-sectional area 1474, FIG. 10 of rod set 1408 of first bay 1402. In the examples of FIGS. 8-10, rod sets 1408, 1410 and 1412 are shown as having cylindrical shaped cross-sections, large cruciform cross-sections, and smaller cruciform shaped cross-sections, but the invention is not limited to any particular size or shape or particular cross-sectional area. Rods 1408, 1410 and 1412 may be star shaped, tristar shaped, hexagonal or any other shape depending on a particular desired application, so long as rods 1412 of last bay 1406 have more drag than rods 1408, and rods 1410 of intermediate bay 1404 have more drag than rods 1408 of first bay 1402 but less drag than rods 1412 of last bay 1406. This latter embodiment without drag inducers is likely to be less effective at higher altitudes, but may be used at lower altitudes where air density is greater and there will be a more direct correlation between higher cross-sectional area rods and increased drag.

The present invention is not limited to the features disclosed, and additional kinetic energy rod features may also be included, as disclosed for example in disclosed in U.S. patent application Ser. Nos. 11/059,891 and 11/060,179 to which this application claims priority and which are incorporated herein by reference, and/or other features as desired for a particular application.

As noted above, the rods of each bay having the relative drag properties as described above will be spaced apart upon deployment whether the rods from each bay are deployed simultaneously or at different times. The timing of deployment of each of the bays is preferably achieved via guidance subsystem 1490, FIG. 2A in carrier or missile 1437 which carries kinetic energy rod warhead 1400. Guidance subsystem 1490 serves as one means for initiating deployment of the plurality of rods 1408, 1410, 1412 in bays 1402, 1404, 1406 as well as timing and sequence. In accordance with the kinetic energy rod warhead and method of the present invention, guidance subsystem 1490 will initiate deployment of the bays 1402, 1404, and 1406 by initiating the detonators of each bay. In one example, kinetic energy rod warhead 1400 is configured with the projectiles having drag properties as described above in accordance with the present invention. Guidance subsystem 1490 deploys plurality of rods 1408 from first bay 1402, deploys plurality of rods 1410 from an intermediate bay or bays 1404, and deploys plurality of rods 1412 from last bay 1406 of kinetic energy rod warhead 1400 simultaneously by initiating all the detonators simultaneously. See, e.g., FIGS. 2A-2D. Alternatively, guidance subsystem 1490 deploys plurality of rods 1408 from first bay 1402, deploys plurality of rods 1410 from intermediate bay or bays 1404, and thereafter deploys plurality of rods 1412 from last bay 1406 by initiating the detonators of the respective bays sequentially. See, e.g., FIGS. 3A-3D. Guidance subsystems are known in the art and typically include, for example, fusing technology also known in the art, and deployment of the projectiles in accordance with this invention may vary depending on the specific purpose and in accordance with the state of the art of such guidance systems.

Thus, the present invention with a plurality of separate bays in a single warhead with penetrators or projectiles configured with unique and different drag properties provide spacing upon deployment resulting in a more lethal warhead.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A kinetic energy rod warhead bay configuration comprising:

a plurality of bays arranged axially along the length of the warhead and separated from one another by at least one end plate, each bay including:

a plurality of rods, an explosive for deploying the rods radially, and a detonator for detonating the explosive;

one said bay structured and arranged as the first bay, wherein the rods of the first bay are configured to have drag;

one said bay structured and arranged as the last bay, wherein the rods of the last bay are configured to have more drag than the rods of the first bay for spacing apart said last bay rods from said first bay rods upon deployment; and at least one other bay structured and arranged as an intermediate bay between said first bay and said last bay, wherein the rods of said intermediate bay are configured to have more drag than the rods of the first bay but less drag than the rods of the last bay to space apart the rods of said at least one other bay from the rods of said first and last bays upon deployment.

2. The kinetic energy rod warhead of claim 1 in which rods of the last bay and the intermediate bay include a drag inducer.

3. The kinetic energy rod warhead of claim 2 in which the drag inducer is collapsible and unfurls when the rods are deployed.

4. The kinetic energy rod warhead of claim 3 in which the drag inducer is compactly stored until deployment.

5. The kinetic energy rod warhead of claim 4 in which the drag inducer includes drag flaps attached at or proximate a distal end of the rod.

6. The kinetic energy rod warhead of claim 5 in which said drag flaps are made of spring steel.

7. The kinetic energy rod warhead of claim 4 in which the drag inducer includes a parachute attached at or proximate a distal end of the rod.

8. The kinetic energy rod warhead of claim 4 in which the drag inducer includes a flare attachment connected at or proximate a distal end of the rod.

9. The kinetic energy rod warhead of claim 4 in which the drag inducer includes streamers attached at or proximate a distal end of rod.

10. The kinetic energy rod warhead of claim 9 in which the streamers are made of plastic.

11. The kinetic energy rod warhead of claim 1 in which the rods are lengthy cylindrical members.

12. The kinetic energy rod warhead of claim 1 in which the rods are made of tungsten.

13. The kinetic energy rod warhead of claim 1 in which the last bay rods have a cross-sectional area greater than a cross-sectional area of rods of the intermediate bay.

14. The kinetic energy rod warhead of claim 13 in which the cross-sectional area of the intermediate bay rods is greater than a cross-sectional area of the rods of the first bay.

15. The kinetic energy rod warhead of claim 1 further including shields between the plurality of bays for separating the bays.

16. The kinetic energy rod warhead of claim 15 in which the shields are made of steel sandwiched between composite material.

17. The kinetic energy rod warhead of claim 1 in which the plurality of bays each include inner end plates proximate the plurality of rods.

18. The kinetic energy rod warhead of claim 17 in which the inner end plates are made of aluminum sandwiched between composite material.

19. A kinetic energy rod warhead bay configuration comprising:

a plurality of bays arranged axially along the length of the warhead and separated from one another along the length of the warhead by at least one end plate, each bay including:

a plurality of rods, an explosive for deploying the rods radially, and a detonator for detonating the explosive;

one said bay structured and arranged as the first bay, wherein the rods of the first bay are configured to have a predetermined cross-sectional area;

one said bay structured and arranged as the last bay, wherein the rods of the last bay are configured to have a cross-sectional area greater than the cross-sectional area of the rods of the first bay for providing increased drag and for spacing apart said last bay rods from said first bay rods upon deployment; and at least one other bay structured and arranged as an intermediate bay between said first bay and said last bay, wherein the rods of said intermediate bay are configured to have a cross-sectional area greater than the cross-sectional area of the rods of the first bay but less than the cross-sectional area of the rods of the last bay for providing greater drag than said first bay rods but less drag than said last bay rods to space apart the rods of said at least one other bay from the rods of said first and last bays upon deployment.

* * * * *

UNITED STATES PATENT AND TRADEMARK OFFICE

CERTIFICATE OF CORRECTION

PATENT NO. : 7,624,683 B2
APPLICATION NO. : 11/185135
DATED : December 1, 2009
INVENTOR(S) : Richard M. Lloyd It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 687 days.

Signed and Sealed this

Twenty-sixth Day of October, 2010

David J. Kappos

David J. Kappos
*Director of the United States Patent and Trademark Office*